US005099716A

United States Patent [19]

Mackal

[11] Patent Number: 5,099,716

[45] Date of Patent: Mar. 31, 1992

[54] INFLATOR LEVER ARM HAVING PROTUBERANCE RESISTING LANYARD ABRASION

[76] Inventor: Glenn H. Mackal, 4923 59th Ave. S., St. Petersburg, Fla. 33715

[21] Appl. No.: 611,610

[22] Filed: Nov. 13, 1990

Related U.S. Application Data

[62] Division of Ser. No. 523,145, May 14, 1990, Pat. No. 5,042,134.

[51] Int. Cl.[5] ..... G05G 1/10; B67D 5/00

[52] U.S. Cl. ..... 74/543; 74/551.1; 74/523; 222/5; 441/94

[58] Field of Search ..... 74/519, 523, 543, 551.9, 74/551.1; 403/215, 208; 441/90, 92-94; 222/5, 6, 475.1; 24/115 G, 136 A, 136 L

[56] References Cited

U.S. PATENT DOCUMENTS

| | | | |
|---|---|---|---|
| 3,406,590 | 10/1968 | Popeil | 74/545 |
| 3,465,375 | 9/1969 | Schnell | 441/94 |
| 3,490,648 | 1/1970 | Fujimoto | 222/5 |
| 3,809,288 | 5/1974 | Mackal | 222/5 |
| 3,911,762 | 10/1975 | Mackal | 74/543 |
| 4,872,626 | 10/1989 | Lienart | 24/136 |
| 4,872,666 | 10/1989 | Smith | 74/543 |
| 4,946,067 | 8/1990 | Kelsall | 441/94 |
| 4,972,971 | 11/1990 | Janko et al. | 441/93 |

*Primary Examiner*—Leslie A. Braun
*Assistant Examiner*—Winnie Yip
*Attorney, Agent, or Firm*—Joseph C. Mason, Jr.; Ronald E. Smith

[57] ABSTRACT

A lanyard that when pulled upon causes a pivotally mounted inflator level arm to rotate about a pivot shaft is secured against separation from the lever arm by being sandwiched between opposing halves of a molded lever arm and being constrained to follow a serpentine path of travel through that molded lever arm. Blind slots formed in opposite halves of the molded lever arm are partially occupied by plugs that constrain the lanyard to follow the serpentine path of travel so that axial forces exerted upon the lanyard are resisted to an enhanced degree.

2 Claims, 1 Drawing Sheet

INFLATOR LEVER ARM HAVING PROTUBERANCE RESISTING LANYARD ABRASION

This is a divisional of copending application Ser. No. 07/523,145 filed on May 14, 1990, now U.S. Pat. No. 5,042,134.

TECHNICAL FIELD

This invention relates, generally, to inflators of the type used in connection with the rapid inflation of life vests and other inflatable articles. More particularly, it relates to an improved means for insuring that the lanyard of an inflator will not separate from its lever arm when a handle that activates the inflator is pulled.

BACKGROUND ART

A typical inflator includes a lever arm or bell crank that is pivotally mounted about a pivot shaft that extends transversely through the inflator. The lever arm of prior art inflators is metallic; an aperture is formed in the metal and the distal end of a flexible lanyard is threaded therethrough and tied or crimped against separation therefrom. Accordingly, the lanyard is abraded by the sharp edges of the aperture through which it is threaded. The proximal end of the lanyard is secured to a handle. Thus, when the handle is pulled, the lever arm rotates about its pivot shaft and causes the puncturing of a gas cartridge within the inflator and the escaping gas is routed into the inflatable article to rapidly inflate it.

There are several structural weaknesses in the typical inflator that might result in device failure. If the lanyard separates from either the handle or the lever arm, for example, the desired inflation will not occur.

Significantly, the prior art, considered as a whole, neither teaches nor suggests how the known lanyard attachment techniques could be improved.

DISCLOSURE OF INVENTION

The present invention addresses and solves the problem of lanyard/lever arm separation. Briefly, the lever arm is molded so that the lanyard sandwiched therewithin is constrained to follow a serpentine path of travel therethrough. In other words, the lanyard is bent at equidistantly spaced intervals along its extent so that an axial force exerted thereto, of the type generated when the inflator handle is pulled, is resisted by an enhanced amount.

The bending is accomplished by a plurality of plugs that extend into slots formed in each half of the lever arm. Each slot is initially at least partially occupied by a plug so that the lanyard is constrained to bypass ea oh plug and to thus follow the aforementioned serpentine path of travel. The plugs are removed when the molding process is completed.

Thus, the metallic lever arm of prior art inflators and its lanyard-abrading aperture is eliminated. Just as importantly, the need to tie or crimp a lanyard after it has been threaded through the aperture is also eliminated. The novel lanyard-attaching means is so strong that the lanyard will break before it separates from the molded lever arm.

It is therefore understood that the primary object of this invention is to advance the art of inflator construction.

A more specific object is to provide a greatly improved means for attaching a lanyard to an inflator lever arm.

These and other important objects and advantages of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

BEST MODES FOR CARRYING OUT THE INVENTION

Figures 1, 2, 3, 4, 5, 6:
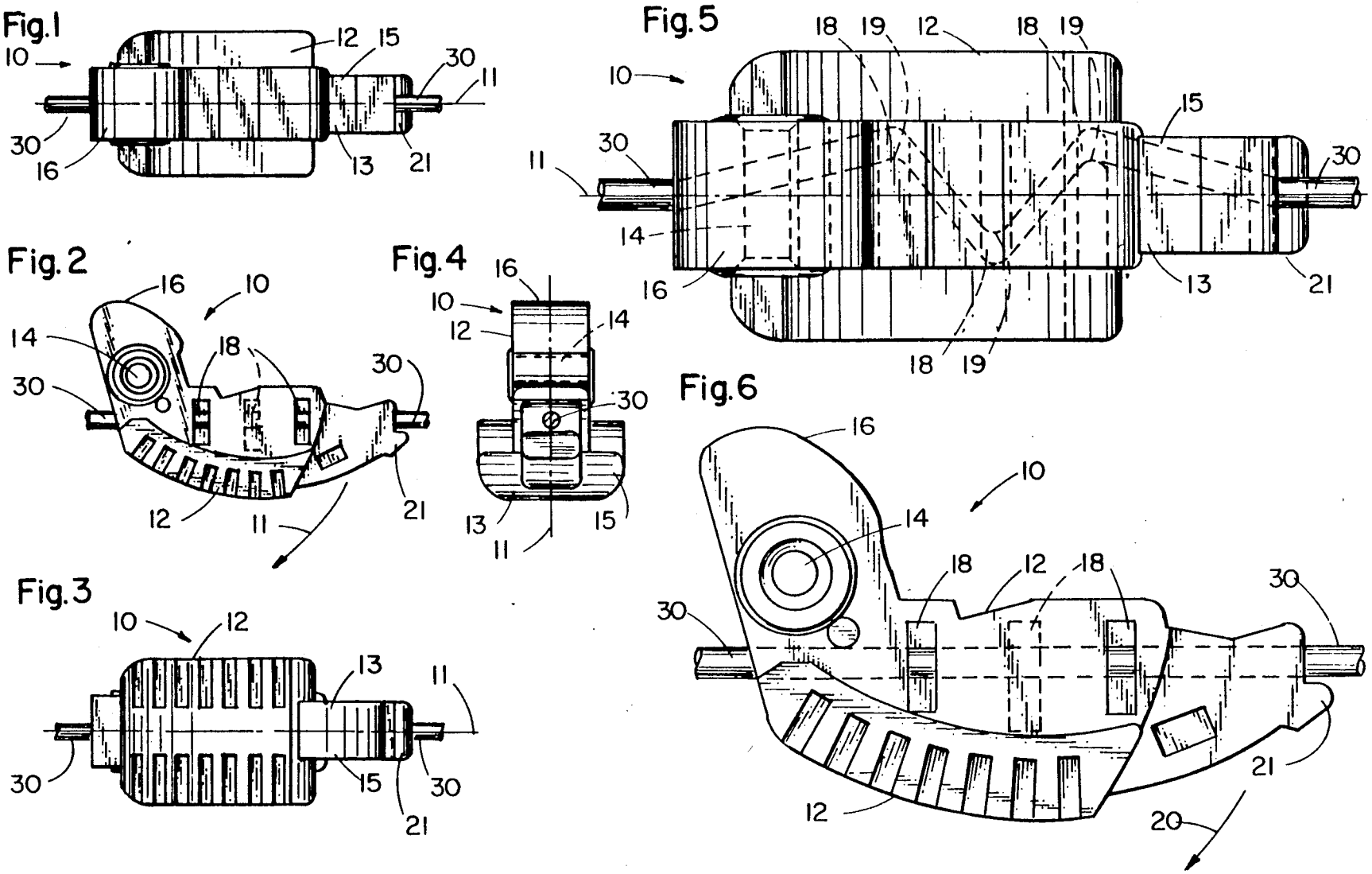
FIG. 1 is a top plan view of an inflator lever arm, showing a lanyard extending therethrough.
FIG. 2 is a side elevational view of the lever arm shown in FIG. 1.
FIG. 3 bottom plan view thereof.
FIG. 4 is an end view thereof.
FIG. 5 is an enlarged top plan view, showing the interior structure of the lever arm in dotted lines.
FIG. 6 is an enlarged side elevational view showing the interior parts in dotted lines.

The improved lever arm of this invention is denoted as a whole by the reference numeral 10 in the FIGS. It should be understood from the outset that lever arm 10 is a molded, non-metallic unit having first and second halves that exhibit bilateral symmetry. Line 11 in the FIGS. indicates the parting line where the two halves meet. Lanyard 30 is positioned in overlying relation to a first half 13 of lever arm 10 before second half 15 thereof is brought into overlying or confronting relation to said first half, i.e., lanyard 30 is disposed in sandwiched relation between the lever arm halves just prior to commencing the molding operation.

The serpentine path of travel of lanyard 30 is depicted in FIG. 5. It will be observed in FIG. 5 and others that in this particular embodiment, there are but three blind slots, each of which is denoted 18, as a whole, that constrain lanyard 30 to follow the serpentine path of travel. Clearly, in view of this disclosure, the number of blind slots could be increased The reference numeral 12 denotes the main central body of lever arm 10, and reference numeral 14 denotes the pivot shaft about which lever arm 10 rotates when lanyard 30 is pulled by the handle secured to its proximal end; the handle is not shown. Camming surface 16 of the lever arm 10 cammingly engages a slidably mounted pin in the inflator and drives it into piercing relation to said cartridge when lanyard 30 is pulled; the inflator and piercing pin are not shown. Lever arm 10 rotates about shaft 14 when the lanyard is pulled in the direction of arrow 20 in FIGS. 2 and 6, as those skilled in the art know.

Protuberance 21 formed at the base of lever arm 10 is novel; it provides a non-abrasive, rounded surface for lanyard 30 when it is reversely turned as denoted by said arrow 20. Note in FIG. 6 that the lanyard emerges from the lever arm in closely spaced relation to the protuberance so that when the lanyard is pulled it is supported where it bends by the protuberance. It should also be observed that main central body 12 of the lever arm is gently curved and that said curvature also supports the lanyard when the lanyard is pulled. The curved wall, as is clearly shown, is offset from the protuberance to further support the lanyard and to lessen the amount of stress applied to the lanyard at the protuberance when the lanyard is pulled.

Each of the blind slots that constrain lanyard 30 to follow the serpentine path of travel is denoted 18, as a whole, as aforesaid. It should be understood that, in the particular embodiment illustrated, the first and last collective slots 18 extend completely through part 13 of lever arm 10 and extend only partly into confronting part 15. Conversely, the medial slot 18 is formed completely through part 15 and extends only partly into part 13. The slot formed by the juxtaposition of two confronting individual slots is hereafter called a collective slot. Thus, when the confronting parts 13 and 15 are brought into juxtaposition with one another as shown in FIG. 5, the opposing complete individual and partial individual slots are brought into alignment with one another to form said collective slots.

However, the slots need not be blind; i.e., each slot could extend completely through the lever arm.

Each collective slot 18 slidably receives a removable plug 19 therein prior to the injection of plastic into the mold that produces lever arm 10. Each plug only partly occupies its associated collective slot, leaving the end or bottom of its collective slot for the lanyard to pass through, as shown. Thus, to be effective, ea oh plug should occupy more than half of each collective slot to force the lanyard into a serpentine path of travel. In the preferred configuration shown in FIG. 5, each plug 19 occupies all of its collective slot 18 except the terminal end thereof, and said terminal end is occupied by the lanyard. It should be noted that the plugs are inserted alternately into opposite ends of the collective slots, to thereby create the desired serpentine path of travel.

Since each collective slot is at least partially occupied by its associated plug at the beginning of the molding process, each slot remains at least partially unfilled with plastic when part 10 has been formed. The plugs 19 are removed at the completion of the molding process but the lanyard 30 remains in its FIG. 5 position because it is embedded in plastic in said serpentine position.

Each plug may have a "V"-shaped groove formed therein to center the lanyard passing thereover. The respective apices of each groove could be laterally offset with respect to one another, however, thereby constraining the lanyard to follow still another serpentine path of travel in a plane orthogonal to the plane of the first-mentioned serpentine path.

Clearly, this invention is new and useful. Moreover, it was not obvious to those of ordinary skill in the art at the time this invention was made.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. An inflator lever arm, comprising:

a first molded part;

a second molded part;

said first and second parts being bilaterally symmetrical with respect to one another so that a complete lever arm is formed when said first and second parts are placed into juxtaposition with one another;

a rounded protuberance being formed at a trailing end of each of said parts;

said protuberance providing a rounded support surface about which a lanyard may turn in the substantial absence of abrasion;

said lanyard disposed in sandwiched relation between said first and second parts;

said lanyard being disposed in overlying relation to said protuberance only when said lanyard is pulled to cause rotation of said lever arm;

said protuberance being integrally formed with each of said parts; and said lanyard following a serpentine path of travel from a front end to said trailing end formed between said two molded parts as it extends through said lever arm.

2. The lever arm of claim 1, wherein said lanyard emerges from said lever arm in closely spaced relation to said protuberance so that when said lanyard is pulled it is supported where it bends by said protuberance, wherein said lever arm has a gently curved wall that also supports said lanyard when said lanyard is pulled, and wherein said curved wall is offset from said protuberance to further support said lanyard and to lessen the amount of stress applied to the lanyard at said protuberance when said lanyard is pulled.

* * * * *